United States Patent [19]

Takahashi et al.

[11] Patent Number: 5,076,241

[45] Date of Patent: Dec. 31, 1991

[54] FUEL INJECTION DEVICE

[75] Inventors: Takeshi Takahashi, Mishima; Hiroshi Sami, Numazu; Takashi Yamamoto, Susono, all of Japan

[73] Assignee: Toyota Jidosha Kabushiki Kaisha, Aichi, Japan

[21] Appl. No.: 408,147

[22] Filed: Sep. 15, 1989

[30] Foreign Application Priority Data

| | | | |
|---|---|---|---|
| Sep. 21, 1988 | [JP] | Japan | 63-122690 |
| Sep. 21, 1988 | [JP] | Japan | 63-122691[U] |
| Sep. 21, 1988 | [JP] | Japan | 63-234822 |
| Nov. 30, 1988 | [JP] | Japan | 63-154885[U] |

[51] Int. Cl.[5] ..... F02M 37/00

[52] U.S. Cl. ..... 123/506; 123/458; 123/41.31

[58] Field of Search ..... 123/506, 458, 498, 446, 123/41.31

[56] References Cited

U.S. PATENT DOCUMENTS

| | | | |
|---|---|---|---|
| 4,445,484 | 5/1984 | Marion | 123/506 |
| 4,619,239 | 10/1986 | Wallenfang | 123/506 |
| 4,622,942 | 11/1986 | Nozaki et al. . | |
| 4,643,155 | 2/1987 | O'Neill . | |
| 4,782,807 | 11/1988 | Takahashi . | |
| 4,821,726 | 4/1989 | Tamura | 123/498 |
| 4,829,967 | 5/1989 | Nuti | 123/506 |
| 4,869,218 | 9/1989 | Fehlmann | 123/41.31 |
| 4,881,504 | 11/1989 | Best | 123/506 |
| 4,958,101 | 9/1990 | Takahashi | 123/498 |
| 4,966,119 | 10/1990 | Mitsuyasu | 123/498 |

FOREIGN PATENT DOCUMENTS

| | | |
|---|---|---|
| 0114375 | 2/1986 | European Pat. Off. . |
| 0243931 | 11/1987 | European Pat. Off. . |
| 3302294 | 7/1984 | Fed. Rep. of Germany . |
| 3423340 | 1/1985 | Fed. Rep. of Germany . |
| 63-113176 | 5/1988 | Japan . |
| 1515846 | 6/1968 | United Kingdom . |

*Primary Examiner*—Carl S. Miller

*Attorney, Agent, or Firm*—Kenyon & Kenyon

[57] ABSTRACT

A unit injector comprising a plunger, a high pressure fuel chamber, and a needle; the pressure of fuel in the high pressure fuel chamber being increased by the plunger. A spill valve is slidably inserted into a bore and is actuated by an actuator. The spill valve has a first annular fitting portion in tight contact with the inner wall of the bore at one end thereof, and has a second annular fitting portion in tight contact with the inner wall of the bore at the other end thereof. The bore has an annular valve seat formed on the wall thereof, and the spill valve has an annular valve portion between the first annular fitting portion and the second annular fitting portion. A high pressure fuel introduction chamber is formed around the spill valve between the first annular fitting portion and the annular valve portion and is continuously connected to the high pressure fuel chamber. A fuel spill chamber is formed around the spill valve between the second annular fitting portion and the annular valve portion, and when the annular valve portion is moved away from the annular valve seat, fuel under a high pressure is spilled out from the high pressure fuel chamber into the fuel spill and the fuel injection is stopped.

23 Claims, 21 Drawing Sheets

FUEL INJECTION DEVICE

BACKGROUND OF THE INVENTION

1. Field of the Invention

The present invention relates to a fuel injection device for use in an internal combustion engine.

2. Description of the Related Art

The present applicants have proposed a unit injector comprising a plunger driven by an engine, a high pressure fuel chamber filled with fuel which is pressurized by the plunger, a needle moved in accordance with the fuel pressure in the high pressure fuel chamber to open a valve opening when the fuel pressure exceeds a predetermined pressure, a spill valve inserted slidably in a bore to control the spillage of fuel in the high pressure fuel chamber, and a piezoelectric element which moves the spill valve axially relative to the bore and controls the opening and closing of the spill valve, wherein the fuel injection is performed when the spill valve is closed (See copending U.S. patent application No. 284,434 or copending British Patent Application No. 8827575.3)

In this unit injector, the end of the bore is open to a fuel spill chamber having an increased diameter, and a valve seat is formed on the end of the bore. The spill valve has an enlarged head portion positioned in the fuel spill chamber and able to be seated on the valve seat. In addition, the spill valve has an annular fitting portion formed at an end thereof opposite to the enlarged head portion and in tight contact with the inner circumferential wall of the bore. A high pressure fuel introduction chamber is formed around the outer circumferential wall of the spill valve between the annular fitting portion and the enlarged head portion, and connected to the high pressure fuel chamber, and a spring is mounted on the spill valve to bias the spill valve in the open direction.

The fuel injection is started by closing the spill valve against the spring, and when the enlarged head portion is moved away from the valve seat, the high pressure fuel in the high pressure fuel chamber is spilled out into the fuel spill chamber via the high pressure fuel introduction chamber, and thus the fuel injection is stopped. In this unit injector, however, when the spill valve is opened to stop the fuel injection, since the high pressure fuel is spilled out into the fuel spill chamber, the pressure of the fuel in the fuel spill chamber is temporarily high, and at this time, since this high pressure acts on the tip face of the enlarged head portion of the spill valve and provides a force pushing the spill valve in the closed direction, the spill valve is closed again almost as soon as it is opened. As a result, problems arise in that the fuel cannot be appropriately injected, and in particular, a good fuel cutting operation of the fuel injection cannot be obtained.

SUMMARY OF THE INVENTION

An object of the present invention is to provide a fuel injection device capable of appropriately injecting fuel and obtaining a good fuel cutting operation of the fuel injection.

According to the present invention, there is provided a fuel injection device of an engine comprising: a housing having a nozzle opening; a plunger movable in the housing and actuated by the engine; a high pressure fuel chamber formed in the housing and defined by the plunger, the pressure of fuel in the high pressure fuel chamber being increased by the plunger; a needle arranged in the housing and opening the nozzle opening to inject fuel in the high pressure fuel chamber from the nozzle opening when the pressure of fuel in the high pressure fuel chamber is higher than a predetermined pressure; a spill valve slidably inserted into a bore formed in the housing the bore having a reduced diameter bore portion, an increased diameter bore portion, and a step portion formed between the reduced diameter bore portion and the increased diameter bore portion and forming an annular valve seat, the spill valve having a reduced diameter portion slidably inserted into the reduced diameter bore portion and an increased diameter portion which are slidably inserted into the increased diameter bore portion, the reduced diameter portion of the spill valve and the increase diameter portion of the spill valve being, spaced in an axial direction of the bore and are in tight contact with an inner circumferential wall of the bore, the spill valve having an annular valve portion which is formed thereon between the reduced diameter portion and the increased diameter portion and can be seated on the annular valve seat, the spill valve and the inner circumferential wall of the bore defining therebetween a high pressure fuel introduction chamber which is positioned between the annular valve portion and the reduced diameter portion and is in continuous communication with the high pressure fuel chamber, the spill valve and inner circumferential wall of the bore defining therebetween a fuel spill chamber positioned between the annular valve portion and the second annular fitting portion; and an actuator for actuating the spill valve to seat the annular valve portion on the annular valve seat when the fuel injection is to be carried out and to move the annular valve portion away from the annular valve seat to spill out fuel in the high pressure fuel chamber into the fuel spill chamber via the high pressure fuel introduction chamber when the fuel injection operation is to be stopped.

The present invention may be more fully understood from the description of preferred embodiments of the invention set forth below, together with the accompanying drawings.

DESCRIPTION OF THE PREFERRED EMBODIMENTS

Figure 1:
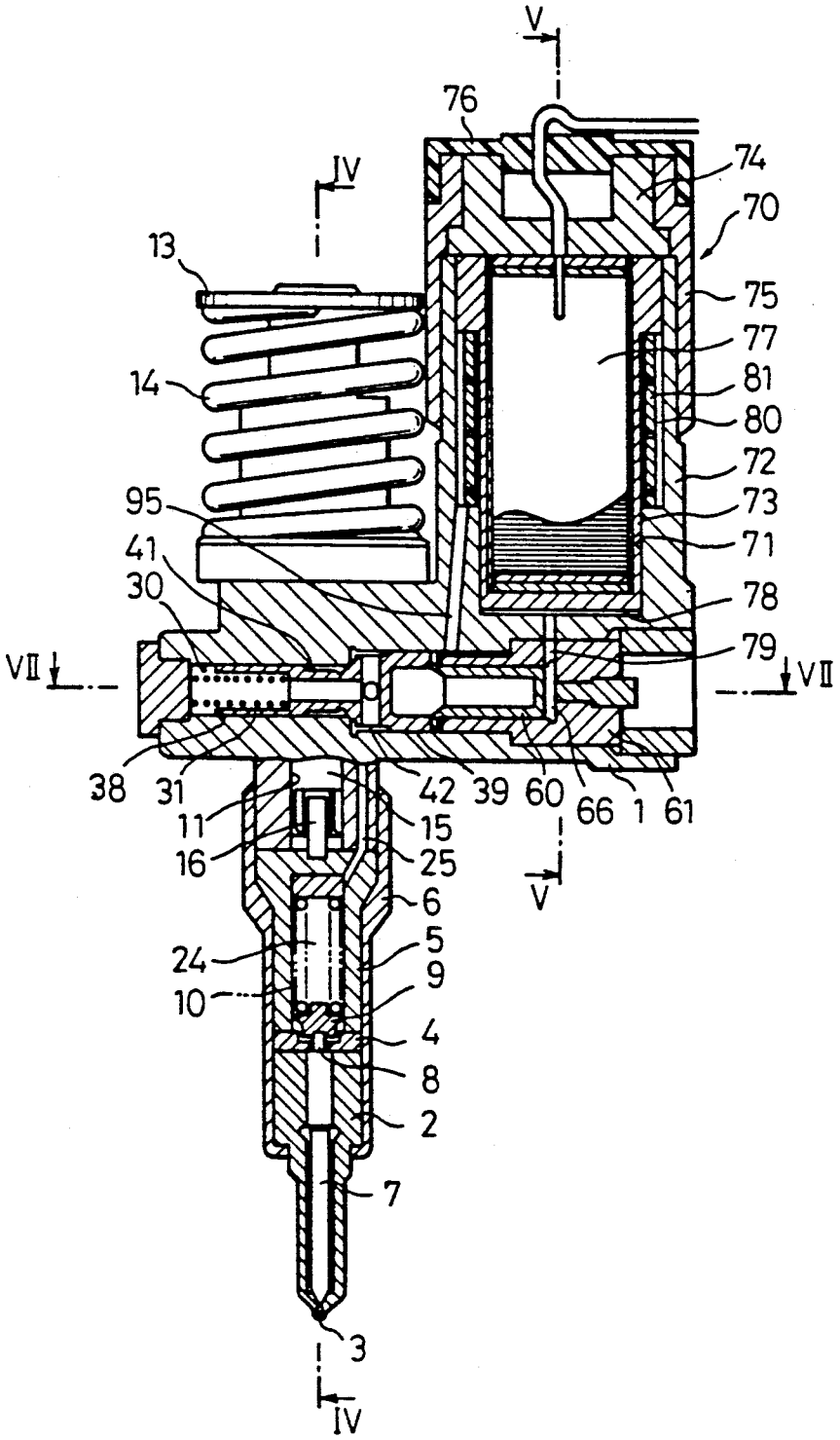
FIG. 1 is a cross-sectional side view of a unit injector, taken along the line I—I in FIG. 4.

FIGS. 1 through 7 illustrate the case where the present invention is applied to a unit injector.

Referring to FIGS. 1 through 4, reference numeral 1 designates a housing body, 2 a nozzle having a nozzle opening 3 at the top portion thereof, 4 a spacer, 5 a sleeve, and 6 a nozzle holder for mounting the nozzle 2, spacer 4, and sleeve 5 to the housing body 1. A needle 7 is slidably inserted in the nozzle 2 and opens and closes the nozzle opening 3. The top of the needle 7 is connected to a spring retainer 9 via a pressure pin 8. The spring retainer 9 is biased downward by a compression spring 10 and this bias force is communicated to the needle 7 through the pressure pin 8. Therefore, the needle 7 is biased in the closed direction by the compression spring 10.

Figure 3:
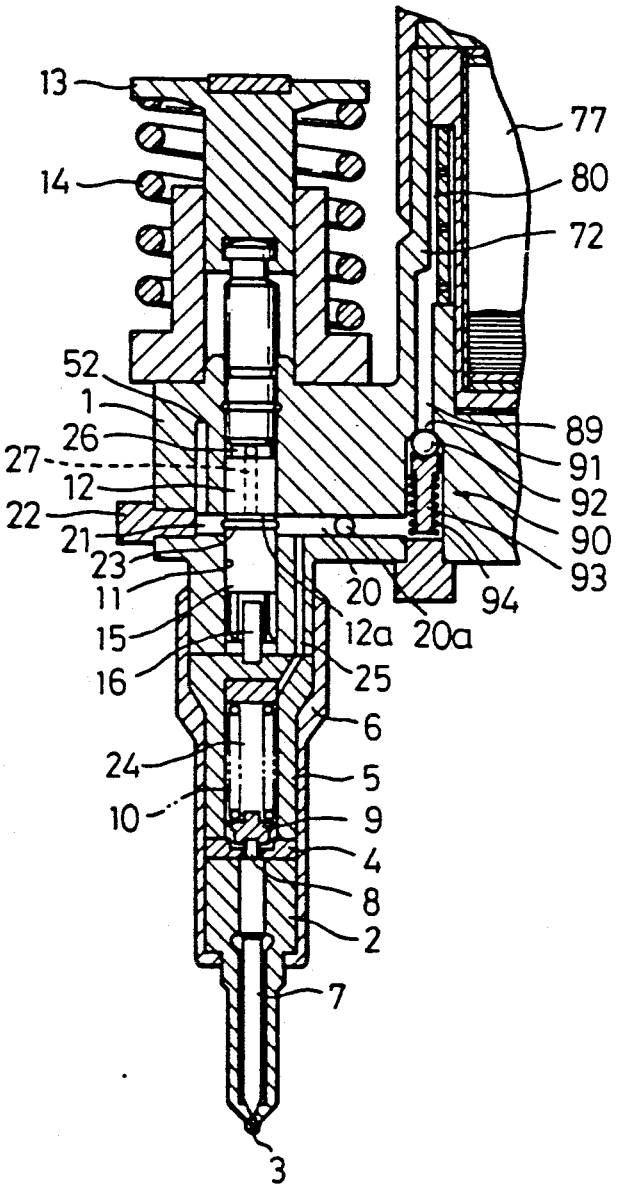
FIG. 3 is a cross-sectional side view of the unit injector, taken along the line III—III in FIG. 4.
Figure 4:
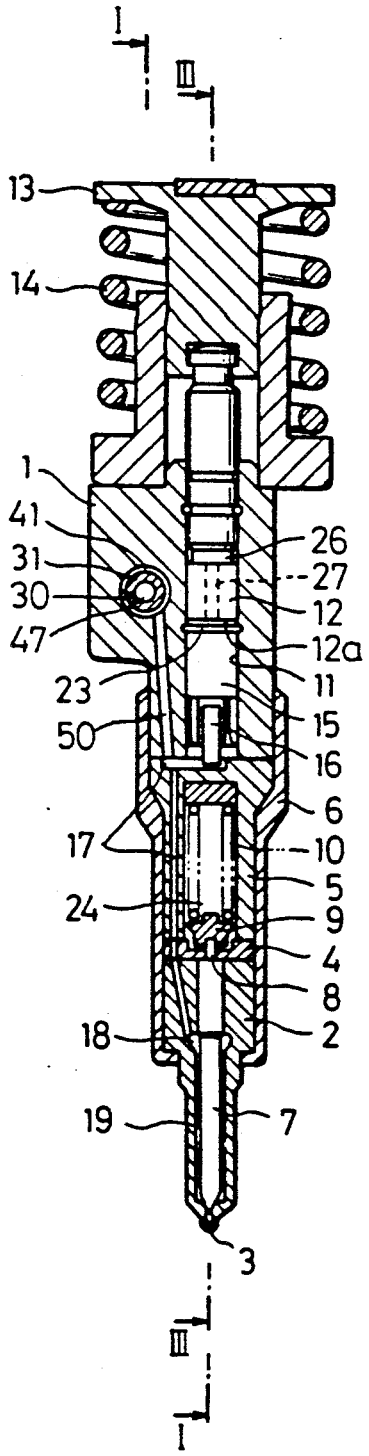
FIG. 4 is a cross-sectional side view of the unit injector, taken along the line IV—IV in FIG. 1.

On the other hand, a plunger bore 11 is formed in the housing body 1 coaxially with the needle 7, and a plunger 12 is slidably inserted in this plunger bore 11. The top end of the plunger 12 is connected to a tappet 13, which is biased upward by a compression spring 14. This tappet 13 is moved up and down by an engine driven (not shown) and thus the plunger 12 is moved up and down in the plunger bore 11. On the other hand, a high pressure fuel chamber 15 defined by the lower end face 12*a* of the plunger 12 is formed in the plunger bore 11 under the plunger 12. This high pressure fuel chamber 15 is connected to a pressurized fuel reservoir 18 via a rod filter 16 and a fuel passage 17 (FIG. 4). The pressurized fuel reservoir 18 is connected to the nozzle opening 3 through an annular fuel passage 19 around the needle 7. Further, a fuel supply port 20 is formed in the inner wall of the plunger bore 11 and is open to the high pressure fuel chamber 15 when the plunger 12 is in the upper position, as shown in FIG. 3. Fuel having a feed pressure of about 2-3 kg/cm$^2$ is supplied from the fuel supply port 20 to the high pressure fuel chamber 15. The fuel supply port 20 is connected to, for example, a fuel tank (not shown) via a fuel discharge passage 20*a* extending perpendicular from the fuel supply port 20 and via a relief valve (not shown) which is opened when the pressure is higher than about 2-3 kg/cm$^2$.

As illustrated in FIG. 3, a fuel port 21, formed when the boring operation of the fuel supply port 20 is carried out, is formed on the side opposite to the fuel supply port 20 with respect to the plunger bore 11, and the outer end portion of the fuel port 21 is closed by a blind plug 22. This fuel port 21 extends coaxially with the fuel supply port 20 and is open to the plunger bore 11. A circumferential groove 23 is formed on the inner wall of the plunger bore 11 and extends from the fuel supply port 20 to the fuel port 21. Consequently, when the plunger 12 moves downward and closes both the fuel supply port 20 and the fuel port 21, the fuel port 21 is interconnected to the fuel supply port 20 via the circumferential groove 23, and thus the fuel in the fuel port 21 is maintained at a pressure which is the same as the feed pressure in the fuel supply port 20. A compression spring receiving chamber 24 receiving therein the compression spring 10 used for biasing the needle 7 is connected to the fuel supply port 20. A compression spring receiving chamber 24 receiving therein the compression spring 10 used for biasing the needle 7 is connected to the fuel supply port 20 via a fuel return passage 25, and the fuel which has leaked into the compression spring receiving chamber 24 is returned to the fuel supply port 20 via the fuel return passage 25. A circumferential groove 26 is formed on the outer circumferential wall of the plunger 12 at a position which is slightly higher than the lower and face 12*a* of the plunger 12, and thus the circumferential groove 26 is connected to the high pressure fuel chamber 15 via a fuel escaping bore 27 formed in the plunger 12.

Figure 2:
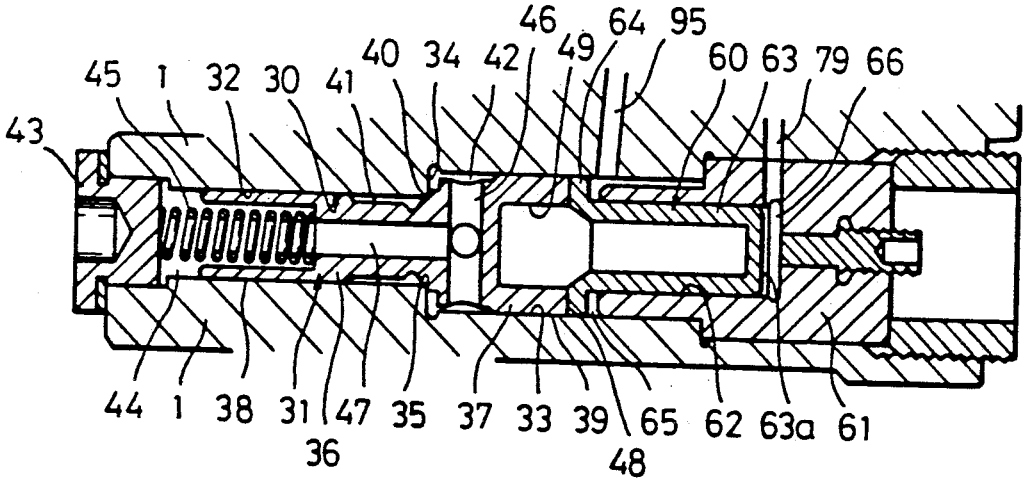
FIG. 2 is an enlarged cross-sectional side view of a portion of the unit injector.

On the other hand, a bore 30 is formed in the housing body 1 and extended in the horizontal plane near the plunger bore 11. Namely, the bore 30 is formed so that the axis thereof is parallel to and spaced from a line which is substantially at a right angle to a common axis of the plunger 12 and needle 7. A spill valve 31 is slidably inserted in the bore 30. As illustrated in FIGS. 1 and 2, the bore 30 comprises a reduced diameter bore portion 32 and an increased diameter bore portion 33 which are coaxially arranged, and a step portion 34 extending perpendicular to the common axis of the reduced diameter bore portion 32 and the increased diameter bore portion 33 is formed between the reduced diameter bore portion 32 and the increased diameter bore portion 33. An annular valve seat 35 is formed at the connecting portion of the step portion 34 and the reduced diameter bore portion 32.

The spill valve 31 comprises a reduced diameter portion 36 located in the reduced diameter bore portion 32, and an increased diameter portion 37 located in the increased diameter bore portion 33. A first annular fitting portion 38, which is in tight contact with the inner wall of the reduced diameter bore portion 32, is formed at the outer end of the reduced diameter portion 36, and a second annular fitting portion 39, which is in tight contact with the inner wall of the increased diameter bore portion 33, is formed at the outer end of the increased diameter bore portion 37. An annular valve portion 40, which can be seated on the valve seat 35, is formed on the outer circumferential wall of the spill valve 31 between the first annular fitting portion 38 and the second annular fitting portion 39. An annular high pressure fuel introduction chamber 41 is formed around the outer circumferential wall of the spill valve 31 between the annular valve portion 40 and the first annular fitting portion 38, and an annular fuel spill chamber 42 is formed around the outer circumferential wall of the spill valve 31 between the annular valve portion 40 and the second annular fitting portion 39.

As illustrated in FIG. 2, a portion of the outer circumferential wall of the increased diameter portion 37, which portion defines the fuel spill chamber 42, has a larger diameter than that of the reduced diameter bore portion 32, and thus the fuel spill chamber 42 has a relatively small volume. The outer end portion of the reduced diameter portion 32 is closed by a blind plug 43, and a spill valve back pressure chamber 44 is formed between the blind plug 43 and the spill valve 31. A compression spring 45 is inserted in the spill valve back pressure chamber 44 to bias the spill valve 31 in a direction in which the annular valve portion 40 of the spill valve 31 moves away from the valve seat 35, i.e., to bias the spill valve 31 in the open direction. A radially extended fuel passage 46 which is open to the fuel spill chamber 42 is formed in the increased diameter portion 37 of the spill valve 31, and an axially extended fuel passage 47 which is open to the spill valve back pressure chamber 44 is formed in the reduced diameter portion 36 of the spill valve 31. These fuel passages 46 and 47 are interconnected within the spill valve 31, and thus the spill valve back pressure chamber 44 is connected to the fuel spill chamber 42 via both the fuel passages 46 and 47. A recess 49, which extends to the vicinity of the fuel passage 46, is formed on the central portion of the end face 48 of the spill valve 31, which end face 48 is located on the second annular fitting portion side. As mentioned above, since the recess 49 and the fuel passages 46, 47 are formed in the spill valve 31, the mass of the spill valve 31 is considerably reduced.

Figure 7:
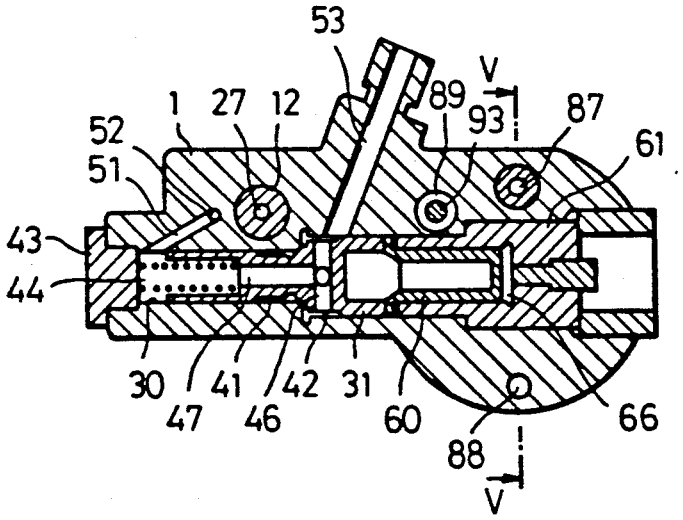
FIG. 7 is a cross-sectional plan view of the unit injector, taken along the line VII—VII in FIG. 1.

As illustrated in FIG. 4, a fuel spill passage 50 extending upward from the fuel passage 17 and continuously open to the high pressure fuel introduction chamber 41 is formed in the housing body 1. This fuel spill passage 50 is continuously connected to the high pressure fuel chamber 15, and thus the high pressure fuel introduction chamber 41 is continuously connected to the high pressure fuel chamber 15. In addition, as illustrated in FIG. 7, the spill valve back pressure chamber 44 is connected to a vertically extending fuel passage 52 via a fuel passage 51 and, as illustrated in FIG. 3, the lower end of the fuel passage 52 is connected to the fuel port 21. Furthermore, as illustrated in FIG. 7, the fuel spill chamber 42 is connected to a fuel discharge passage 53, and fuel discharged from the fuel discharge passage 53 is returned, for example, to a fuel tank (not shown).

As illustrated in FIGS. 1 and 2, a rod guide 61 having a rod bore 62 therein for supporting and guiding a rod 60, is fitted into the outer end of the increased diameter bore portion 33 of the bore 30. The rod 60 comprises a hollow cylindrical reduced diameter portion 63 slidably inserted into the rod bore 62, and an increased diameter portion 64 slidably inserted into the increased diameter bore portion 33, and the end face of the increased diameter portion 64 is caused to abut against the end face 48 of the spill valve 31. A rod back pressure chamber 65 is formed between the inner end of the rod guide 61 and the increased diameter portion 64 of the rod 60, and a pressure control chamber 66 defined by the end face 63*a* of the reduced diameter portion 63 is formed at the end portion of the rod 60, which is located opposite to the increased diameter portion 64. An actuator 70 is arranged above the pressure control chamber 66.

As can be seen from FIGS. 1 and 2, the rod 60 has a hollow cylindrical shape, and thus the mass of the rod 60 is considerably reduced.

Figure 5:
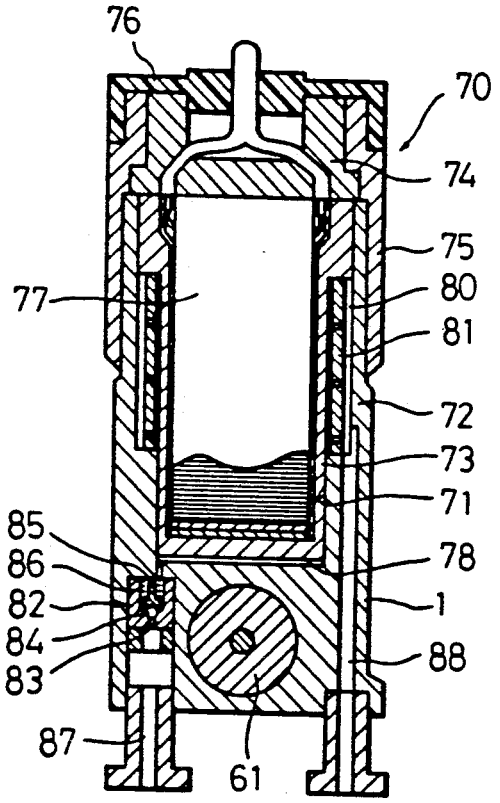
FIG. 5 is a cross-sectional side view of the unit injector, taken along the line V—V in FIGS. 1 and 7.
Figure 6:
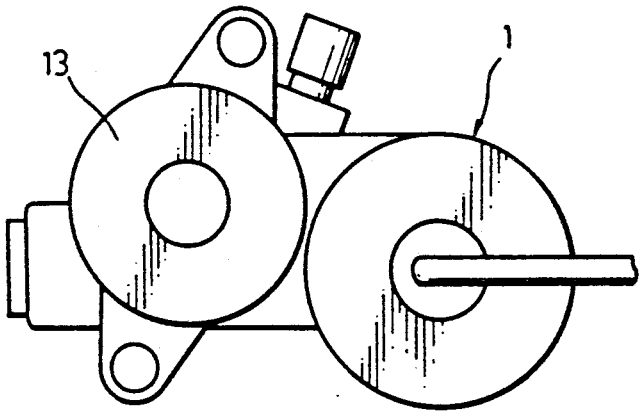
FIG. 6 is a plan view of the unit injector.

As illustrated in FIGS. 1 and 5, the actuator 70 comprises an actuator housing 72 integrally formed with the housing body 1 and forming a piston bore 71 therein, a piston 73 slidably inserted into the piston bore 71, an end plate 74 covering the top portion of the actuator housing 72, an end plate holder 75 for fixing the end plate 74 to the top portion of the actuator housing 72, and a cap 76 covering the upper end portion of the end plate 74 and made of a plastic. A piezoelectric element 77 made of a plurality of stacked piezoelectric element plates is inserted between the piston 73 and the end plate 74, and a variable volume chamber 78 defined by the lower end face of the piston 73 is formed in the piston bore 71 beneath the piston 73 and is connected to the pressure control chamber 66 via fuel passage 79. An annular cooling chamber 80 is formed between the piston 73 and the actuator housing 72, and a compression spring 81 is inserted into the cooling chamber 80 to bias the piston 73 upward. Accordingly, when a charge is applied to the piezoelectric element 77, the piezoelectric element 77 expands axially, and as a result, the volume of the variable volume chamber 78 is reduced, and when the charge of the piezoelectric element 32 is discharged, the piezoelectric element 32 is axially contracted, and as a result, the volume of the variable volume chamber 78 is increased.

As illustrated in FIG. 5, a check valve 82 is inserted in the housing body 1. This check valve 82 is provided with a ball 84 for opening and closing a valve port 83, a rod 85 for restricting the amount of lift of the ball 84, and a compression spring 86 for biasing the ball 84 and rod 85 downward, and therefore, the valve port 83 is normally closed by the ball 84. The valve port 83 of the check valve 82 is connected, for example, to a low pressure fuel pump (not shown) via a fuel inflow passage 87, and fuel having a low pressure of 2-3 kg/cm$^2$ is fed from the fuel inflow passage 87. The check valve 82 permits only the inflow of fuel into the variable volume chamber 78, and thus when the pressure of fuel in the variable volume chamber 78 falls below 2-3 kg/cm$^2$, additional fuel is supplied to the variable volume chamber 78. Therefore, the variable volume chamber 78 is always filled with fuel.

As illustrated in FIG. 5, the lower end portion of the cooling chamber 80 is connected, for example, to a low pressure fuel pump (not shown) via a fuel inflow passage 88, and fuel having a low pressure of 2-3 kg/cm$^2$ is supplied to the cooling chamber 80 from the fuel inflow passage 88. The piezoelectric element 77 is cooled by this fuel. In addition, as illustrated in FIG. 3, the lower end portion of the cooling chamber 80 is connected to the fuel supply port 20 via a fuel outflow passage 89, and a check valve 90 permitting only the flow of fuel from the cooling chamber 80 toward the fuel supply port 20 is arranged in the fuel outflow passage 89. This check valve 90 comprises a ball 92 for opening and closing a valve port 91, a rod 93 for restricting the amount of lift of the ball 92, and a compression spring 94 for biasing the ball 92 and the rod 93 upward. Fuel in the cooling chamber 80 is fed into the fuel supply passage 20 via the fuel outflow passage 89, after cooling the piezoelectric element 77. Furthermore, as illustrated in FIGS. 1 and 2, the lower end portion of the cooling passage 80 is connected to the rod back pressure chamber 65 via a fuel passage 95, and thus in this embodiment the rod back pressure chamber 65 is filled with fuel having a pressure of 2-3 kg/cm$^2$.

As mentioned above, fuel is supplied to the cooling chamber 80 via the fuel inflow chamber 88, and after cooling the piezoelectric element 77, the fuel is fed into the fuel supply port 20 via the fuel outflow passage 89 and the check valve 90. When the plunger 12 is at the upper position as shown in FIG. 3, fuel is supplied to the high pressure fuel chamber 15 from the fuel supply port 20, and therefore, the pressure in the high pressure fuel chamber 15 is a low pressure of about 2-3 kg/cm$^2$. On the other hand, at this time the piezoelectric element 77 is fully contracted, and thus the fuel pressure in the variable volume chamber 78 and the pressure control chamber 66 is a low pressure of about 2-3 kg/cm$^2$. Therefore, the spill valve 31 is moved to the right in FIGS. 1 and 2 by the compression spring 45 and the annular valve portion 40 is moved away from the valve seat 35, i.e., the spill valve 31 is opened. Consequently, low pressure fuel in the high pressure fuel chamber 15 is fed into the fuel spill chamber 42, on one hand via the fuel spill passage 50 and the high pressure fuel introduction chamber 41, and on the other hand via the spill valve back pressure chamber 44 and the fuel passages 47, 46 of the spill valve 31, and the fuel fed into the fuel spill chamber 42 is discharged from the fuel discharge passage 53. Consequently, at this time, the high pressure fuel introduction chamber 41, the fuel spill chamber 42, and the spill valve back pressure chamber 44 are also filled with low pressure fuel having a pressure of 2-3 kg/cm$^2$.

When the plunger 12 is moved downward, the fuel supply port 20 and the fuel port 21 are closed by the plunger 12, but since the spill valve 31 is open, the fuel in the high pressure fuel chamber 15 flows out into the fuel spill chamber 42 via the fuel spill passage 50 and the high pressure fuel introduction chamber 41 of the spill valve 31. Consequently, also at this time, the pressure of fuel in the high pressure fuel chamber 15 is a low pressure of about 2-3 kg/cm$^2$.

When a charge is given to the piezoelectric element 77 to start the fuel injection, the piezoelectric element 77 expands axially, and as a result, the piston 73 is moved downward, and thus the fuel pressure in the variable volume chamber 78 and the pressure control chamber 66 is rapidly increased. When the fuel pressure in the pressure control chamber 66 is increased, the rod 60 is moved to the left in FIGS. 1 and 2, and therefore, the spill valve 31 is also moved to the left, and as a result, the annular valve portion 40 of the spill valve 31 abuts against the valve seat 35, and thus the spill valve 31 is closed. When the spill valve 31 is closed, the fuel pressure in the high pressure fuel chamber 15 is rapidly increased due to the downward movement of the plunger 12, and when the fuel pressure in the high pressure fuel chamber 15 exceeds a predetermined pressure, for example, 1500 kg/cm$^2$ or more, the needle 7 is opened and fuel is injected from the nozzle opening 3. At this time, a high pressure is also applied to the high pressure fuel introduction chamber 41 of the spill valve 31 through the fuel spill passage 50, but the pressure receiving areas of the two axial end surfaces of the high pressure fuel introduction chamber 41 are equal, and thus a drive force does not act on the spill valve 31.

When the charge of the piezoelectric element 77 is discharged to stop the fuel injection, the piezoelectric element 77 is contracted, and as a result, the piston 73 is moved upward by the compression spring 81, and therefore, the fuel pressure in the variable volume chamber 78 and the pressure control chamber 66 is reduced. As mentioned earlier, the masses of the rod 60 and the spill valve 31 are small, and therefore, when the fuel pressure in the pressure control chamber 66 is reduced, the rod 60 and the spill valve 31 are immediately moved to the right in FIGS. 1 and 2 by the spring force of the compression spring 45, and as a result, the annular valve portion 40 of the spill valve 31 is moved away from the valve seat 35, and thus the spill valve 31 is immediately opened.

When the spill valve 31 is opened, the fuel under a high pressure in the high pressure fuel chamber 15 is spouted into the fuel spill chamber 42 via the fuel spill passage 50 and the high pressure fuel introduction chamber 41 and thus the fuel pressure in the high pressure fuel chamber 15 rapidly drops.

Since the volume of the fuel spill chamber 15 is small, when the fuel under high pressure is spouted into the fuel spill chamber 42 as mentioned above, the fuel pressure in the fuel spill chamber 42 is temporarily very high. As mentioned earlier, since the second annular fitting portion 39 is formed between the fuel spill chamber 42 and the end face 48 of the increased diameter portion 37 of the spill valve 31, the high pressure generated in the fuel spill chamber 42 does not act on the end face 48 of the increased diameter portion 37 of the spill valve 31, and as a result, this high pressure generated in the fuel spill chamber 42 acts on the cross-sectional area remaining after the cross-sectional area of the reduced diameter bore portion 32 is subtracted from the cross-sectional area of the increased diameter bore portion 33, only in a direction wherein the spill valve 31 is opened, and thus the spill valve 31 is urged in the open direction thereof due to the high pressure generated in the fuel spill chamber 42. In addition, when the fuel under high pressure is spouted into the fuel spill chamber 42, a part of this fuel under high pressure is spouted into the spill valve back pressure chamber 44 from the fuel passage 47 via the fuel passage 46 of the spill valve 31. When the fuel under high pressure is spouted from the fuel passage 47 as mentioned above, a force urging the spill valve 31 in the open direction thereof acts on the spill valve 31 due to the reaction force of the spouting operation of the fuel. Furthermore, when the fuel under high pressure is spouted into the spill valve back pressure chamber 44, the fuel pressure in the spill valve back pressure chamber 44 is increased, and as a result, a force urging the spill valve 31 in the open direction thereof acts on the spill valve 31 due to the fuel pressure in the spill valve back pressure chamber 44. As mentioned above, when the spill valve 31 is opened, a force urging the spill valve 31 in the open direction thereof acts on the spill valve 31 due to an increase in the pressure of fuel in the fuel spill chamber 42, the spouting of fuel from the fuel passage 47, and an increase in the pressure of fuel in the spill valve back pressure chamber 44, and as a result, the spill valve 31 is rapidly opened as soon as the annular valve portion 40 thereof is moved away from the valve seat 35, and in addition, once the spill valve 31 is opened, it remains open. Consequently, when the spill valve 31 is opened, the fuel pressure in the high pressure fuel chamber 15 drops continuously and rapidly , and as a result, when the spill valve 31 is opened, the needle 7 is immediately moved down and the injection of fuel is stopped.

In addition, the pressure of fuel pressurized in the high pressure fuel chamber 15 becomes high as the engine speed or the engine load becomes high. Consequently, when the engine speed or the engine load becomes high, an increase in the fuel pressure, which occurs in the fuel spill chamber 42 when the spill valve 31 is opened, becomes large. Furthermore, at this time, the spouting of fuel from the fuel passage 47 becomes strong, and an increase in the pressure of fuel in the spill valve back pressure chamber 44 becomes large. Consequently, when the engine speed or the engine load becomes high, a force urging the spill valve 31 in the open direction thereof becomes correspondingly stronger.

When the piezoelectric element 77 is contracted to open the spill valve 31, and accordingly the fuel pressure in the variable volume chamber 78 is reduced, if the fuel pressure in the variable volume chamber 78 falls below the fuel pressure in the fuel inflow passage 87 (FIG. 5), additional fuel under a low pressure is supplied to the variable volume chamber 78 via the check valve 82.

When the plunger 12 is further moved downward, the circumferential groove 26 formed on the outer circumferential wall of the plunger 12 is in communication with the fuel supply port 20 and the fuel port 21, and at this time, the spill valve 31 is normally open. But, when the spill valve 31 is kept closed for some reason, the fuel pressure in the high pressure fuel chamber 15 remains high, and therefore, when the circumferential groove 26 is in communication with the fuel supply port 20 and the fuel port 21, the fuel under high pressure in the high pressure fuel chamber 15 is spouted into the fuel supply port 20 and the fuel port 21. At this time, the fuel under high pressure spouted into the fuel supply port 20 and the fuel port 21 cannot flow into the cooling chamber 80 due to the presence of the check valve 90, and thus flows into the spill valve back pressure chamber 44 via the fuel passages 51 and 52 and then into the fuel spill chamber 42 via the fuel passages 46 and 47 of the spill valve 31, and as a result, since the fuel pressure in the spill valve back pressure chamber 46 and the fuel spill chamber 42 becomes high, a strong force urging the spill valve 31 in the open direction thereof acts on the spill valve 31, and thus the spill valve 31 is forcibly opened. Therefore, the circumferential groove 26 acts as a failsafe factor preventing the spill valve 31 from being kept closed for some reason.

Then the plunger 12 is moved upward and returned to the uppermost position, and subsequently, the plunger 12 begins to move downward. Accordingly, although a powerful downward drive force is applied to the plunger 12 so that the fuel pressure of the high pressure fuel chamber 15 is increased to 1500 kg/cm$^2$ or more, the bore 30 is arranged at the side of the plunger 12 and is not deformed, and thus a smooth sliding action of the spill valve 31 is ensured. Further, the bore 30 is extended horizontally at the side of the plunger 12, and therefore, the bore 30 can be located near the high pressure fuel chamber 15. As a result, the length of the fuel spill passage 50 can be shortened and thus the volume of the high pressure fuel chamber 15, which includes the fuel spill passage 50, can be reduced. Therefore, the fuel pressure in the high pressure fuel chamber 15 is easily increased to a high level, and thus the injected fuel is properly atomized. Further, since the volume of the high pressure fuel chamber 15 can be reduced, the fuel pressure in the high pressure fuel chamber 15 is immediately reduced when the spill valve 31 is opened, and thus the fuel injection is immediately stopped. Accordingly, when the spill valve 31 is opened, the fuel injection does not continue under a low pressure, and thus the generation of smoke is suppressed and the engine output and the fuel consumption rate are improved. Moreover, the amount of fuel injection is immediately increased and the fuel injection is immediately stopped by the opening and closing of the spill valve 31, and therefore, a correct pilot injection is made.

Because the bore 30 extends horizontally at the side of the plunger 12, the lateral width of the unit injector can be reduced, and further, by arranging the piezoelectric element 77 so that the axis thereof is substantially at a right angle to the common axis of the bore 30 and rod 60, i.e., substantially at a right angle to the common axis of the plunger 12 and needle 7, the lateral width of the unit injector can be further reduced.

Figure 8:
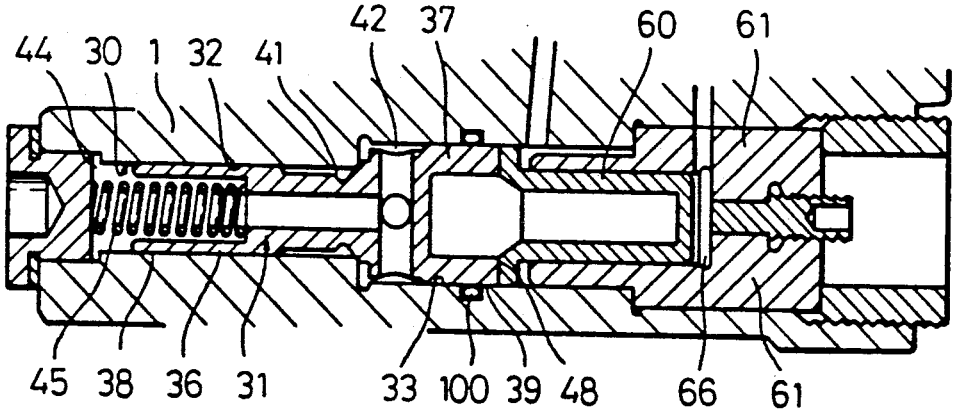
FIG. 8 is an enlarged cross-sectional side view of an alternative embodiment of a portion of the unit injector.
Figure 9:
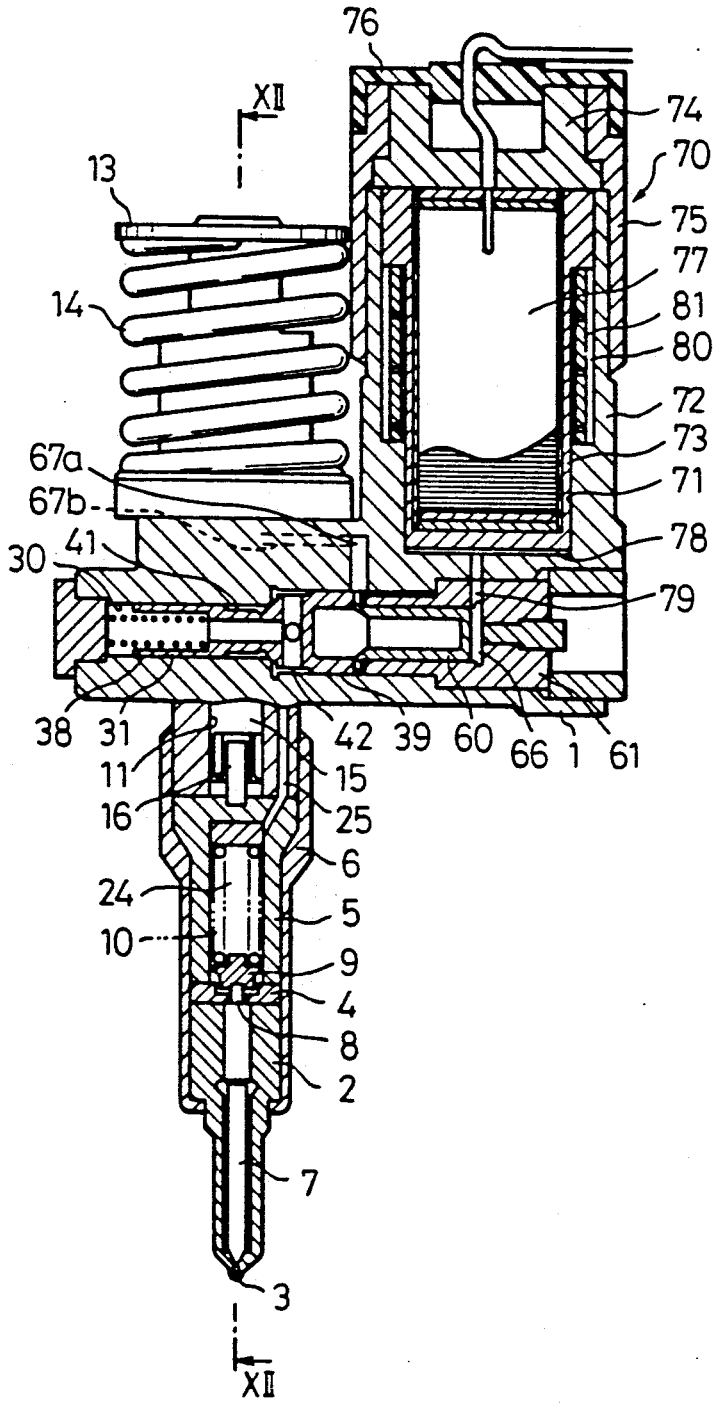
FIG. 9 is a cross-sectional side view of a second embodiment of the unit injector, taken along the line IX—IX in FIG. 12.
Figure 10:
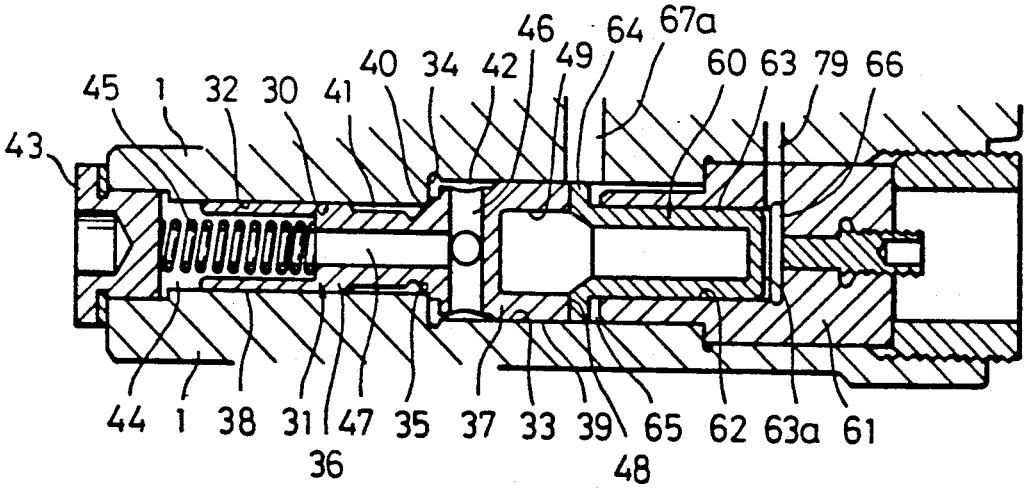
FIG. 10 is an enlarged cross-sectional side view of a portion of the unit injector shown in FIG. 9.
Figure 11:
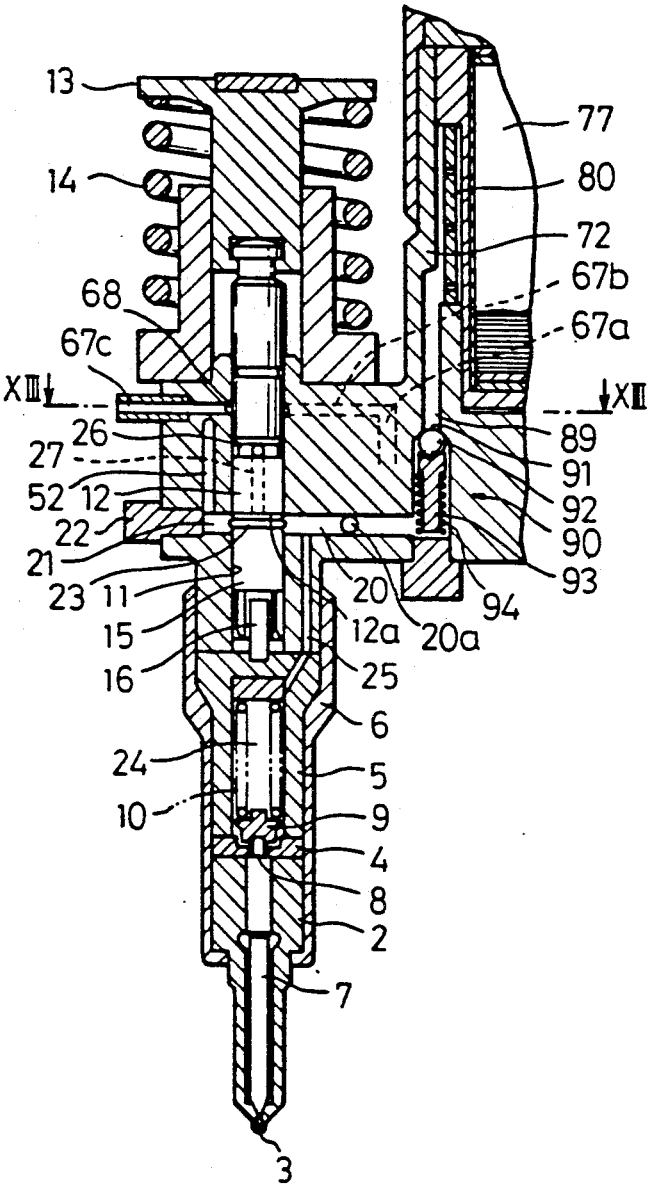
FIG. 11 is a cross-sectional side view of the unit injector shown in FIG. 9 taken along the line XI—XI in FIG. 12.
Figure 12:
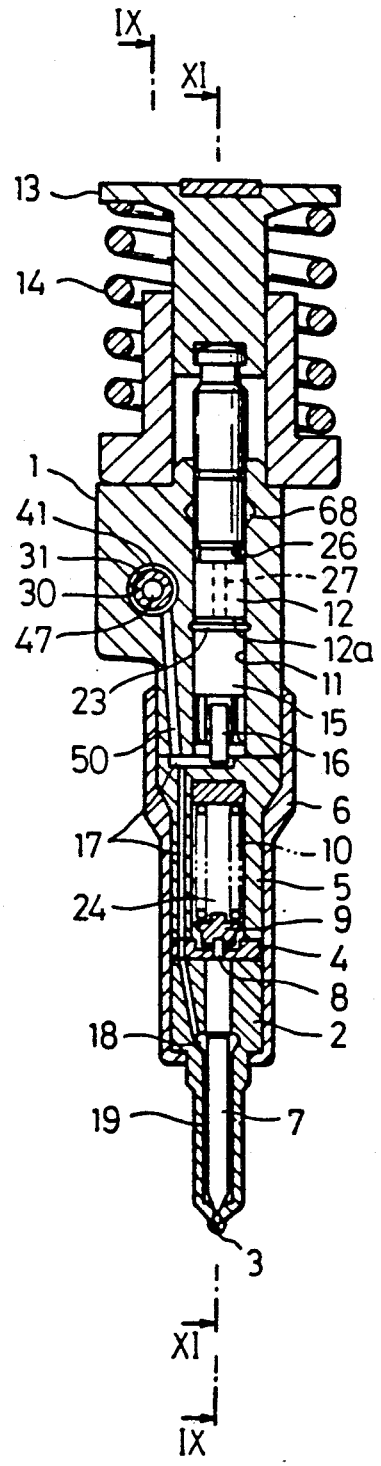
FIG. 12 is a cross-sectional side view of the unit injector, taken along the line XII—XII in FIG. 9.
Figure 13:
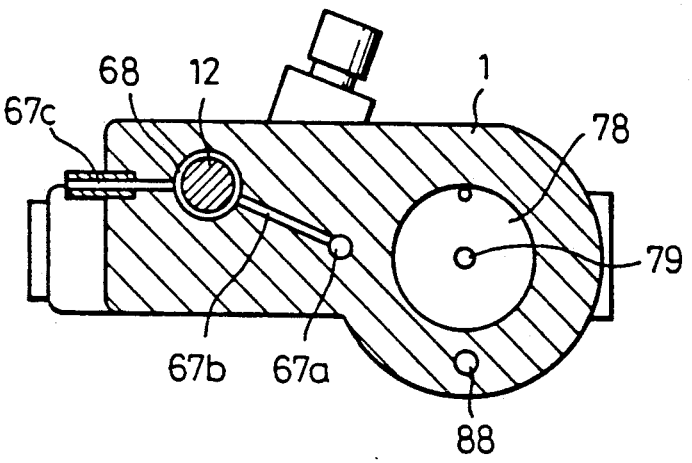
FIG. 13 is a cross-sectional plan view of the unit injector shown in FIG. 9, taken along the line—XIII—XIII in FIG. 11.

FIG. 8 illustrates an alternative embodiment. In this embodiment, a seal member 100, for example, an O ring, is arranged between the increased diameter portion 37 of the spill valve 31 and the increased diameter bore portion 33 of the bore 30. Consequently, in this embodiment, it is possible to further prevent the high pressure generated in the fuel spill chamber 42 from acting on the end face 48 of the increased diameter portion 37 of the spill valve 31 when the spill valve 31 is opened.

FIGS. 9 through 13 illustrate a second embodiment of the unit injector. In this embodiment, similar components are indicated by the same reference numerals as used in FIGS. 1 through 7.

Referring to FIGS. 9 through 13, in this embodiment, the housing body 1 is provided with an atmospheric pressure bore 67*a* which is open to and extends upward from the rod back pressure chamber 65 formed between the inner end of the rod guide 61 and the increased diameter portion 64 of the rod 60. The upper end of the atmospheric pressure bore 67*a* is connected to an annular groove 68 formed on the inner circumferential wall of the plunger bore 11 via an atmospheric pressure bore 67*b* extending horizontally. The annular groove 68 is connected, for example, to a fuel tank (not shown) via an atmospheric pressure bore 67*c*, i.e., the annular groove 68 is open to the atmospheric pressure region. Consequently, the rod back pressure chamber 65 is open to the atmospheric pressure region via the atmospheric pressure bores 67*a*, 67*b*, the annular groove 68 and the atmospheric pressure bore 67*c*, and thus the pressure in the rod back pressure chamber 65 is maintained at the atmospheric pressure. As a result, in this embodiment, a force urging the spill valve 31 in the closed direction thereof is not generated, and consequently, when the piezoelectric element 77 is contracted to stop the fuel injection, it is possible to further rapidly open the spill valve 31 and keep the spill valve 31 in an open state. In addition, the annular groove 68 also serves to catch fuel which has leaked from between the plunger bore 11 and the plunger 12.

Figure 14:
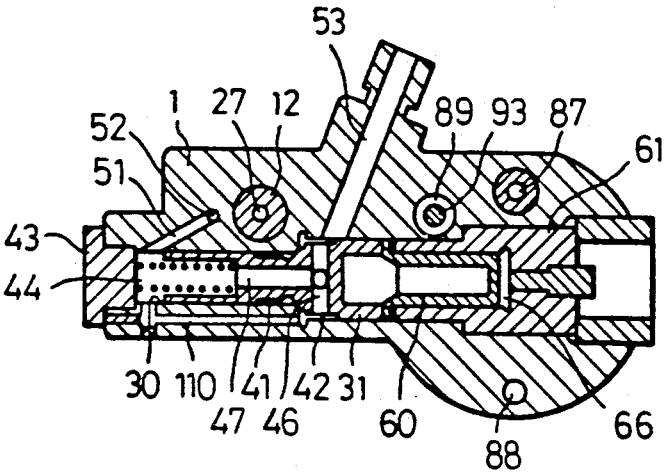
FIG. 14 is a cross-sectional plan view of a third embodiment of the unit injector.
Figure 15:
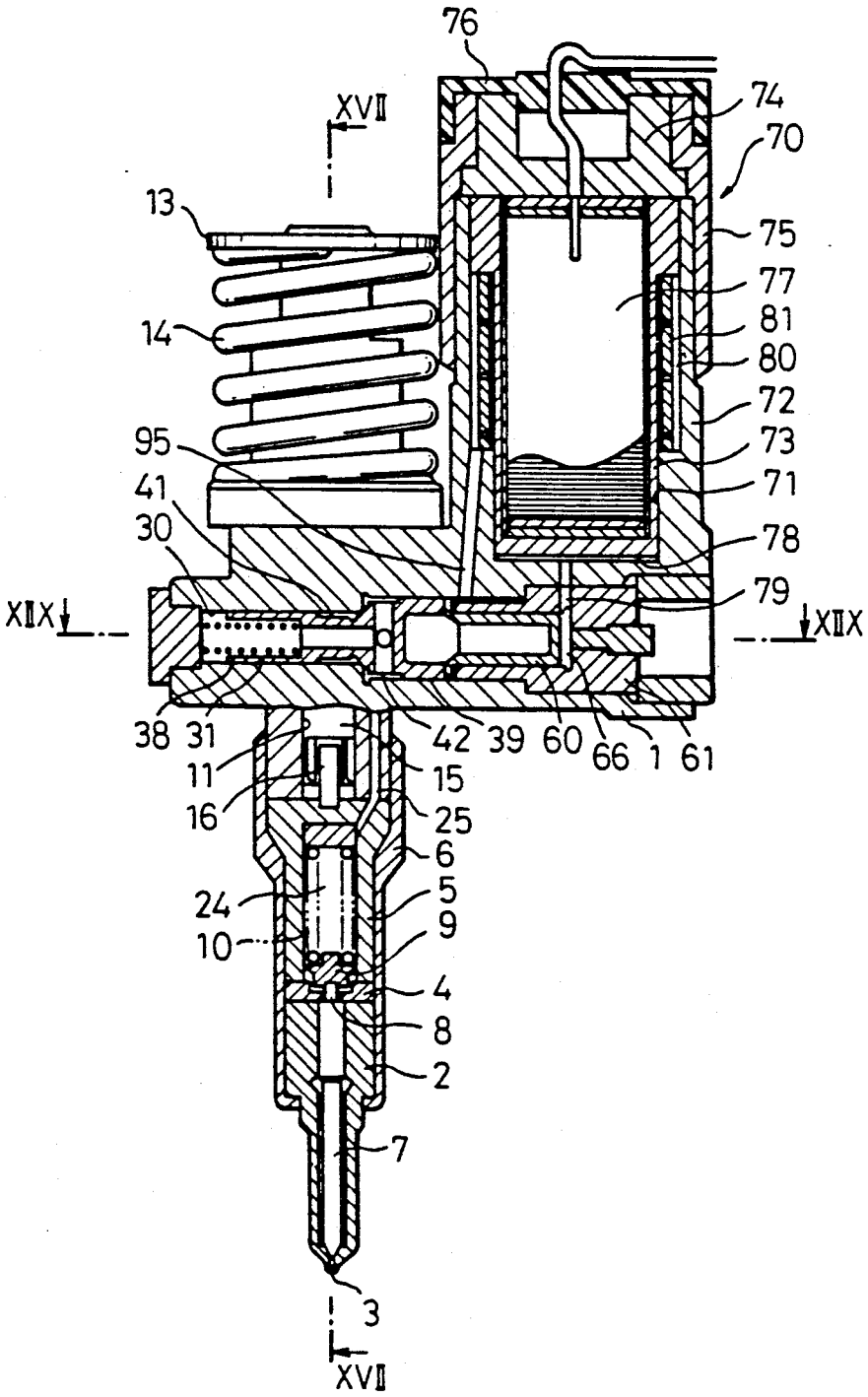
FIG. 15 is a cross-sectional side view of a fourth embodiment of the unit injector, taken along the line XV—XV in FIG. 17.
Figure 16:
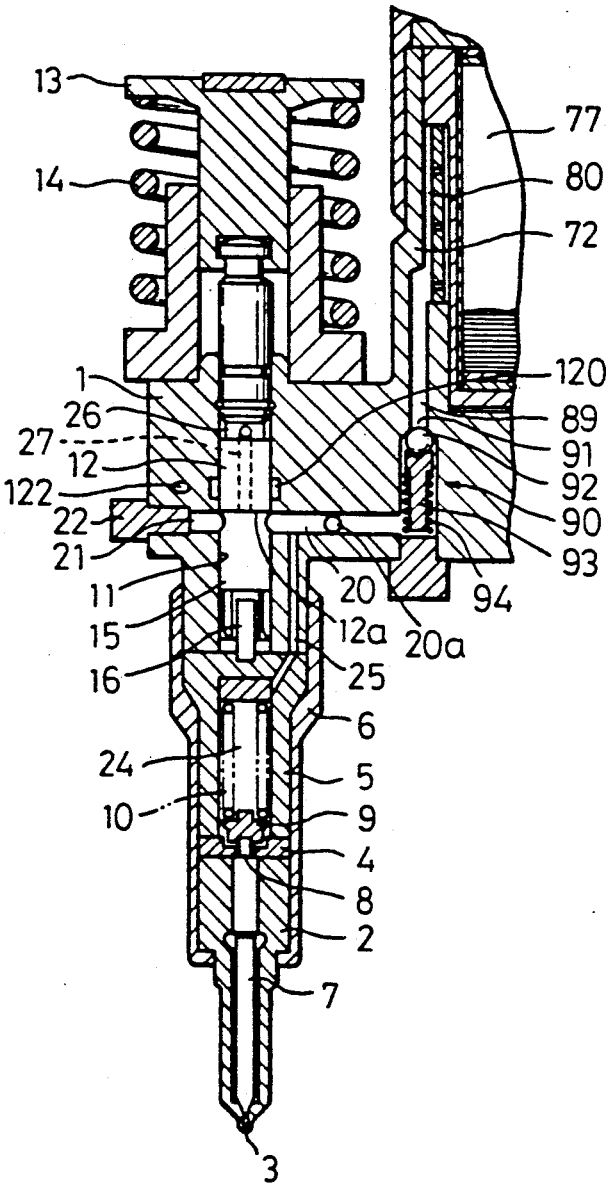
FIG. 16 is a cross-sectional side view of the unit injector shown in FIG. 15, taken along the line XVI—XVI in FIG. 17.
Figure 17:
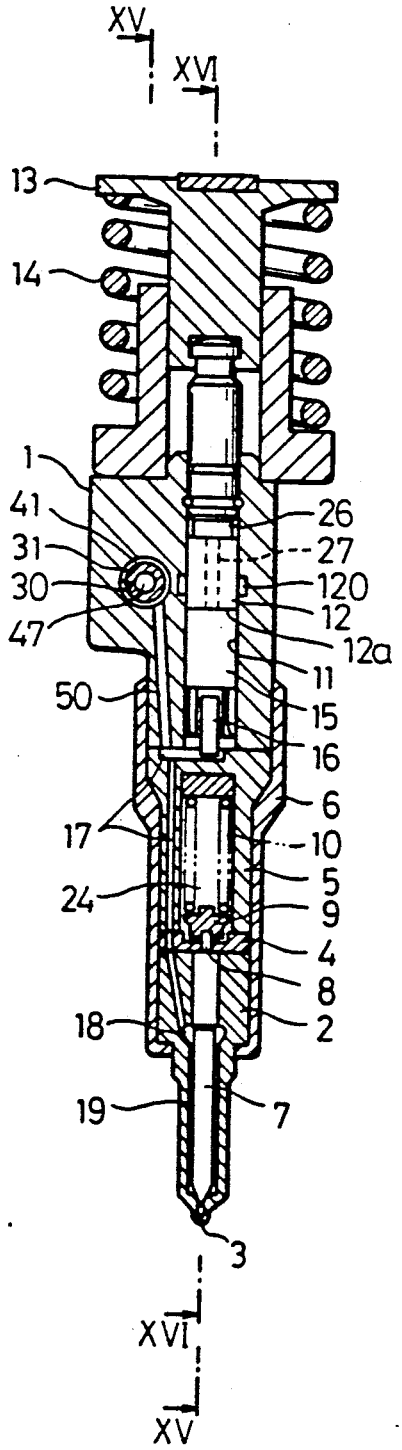
FIG. 17 is a cross-sectional side view of the unit injector, taken along the line XVII—XVII in FIG. 15.

FIG. 14 illustrates a third embodiment of the unit injector. In FIG. 14, similar components are indicated by the same reference numerals as used in FIGS. 1 through 7.

Referring to FIG. 14, in this embodiment, a fuel passage 110 interconnecting the fuel spill chamber 42 to the spill valve back pressure chamber 44 is formed in the housing body 1. Consequently, in this embodiment, when the piezoelectric element 77 is contracted to stop the fuel injection, and thus the fuel under high pressure is spouted into the fuel spill chamber 42, a part of the fuel under high pressure spouted into the fuel spill chamber 42 is fed into the spill valve back pressure chamber 44, on one hand via the fuel passages 46 and 47 formed in the spill valve 31, and on the other hand via the fuel passage 110 formed in the housing body 1. Accordingly, since the fuel under high pressure in the fuel spill chamber 42 is fed into the spill valve back pressure chamber 44 via a plurality of separate fuel passages arranged in parallel, the flow area of the fuel passage interconnecting the fuel spill chamber 42 to the spill valve back pressure chamber 44 is increased. Therefore, the fuel under high pressure in the fuel spill chamber 42 is immediately fed into the spill valve back pressure chamber 44, without a pressure drop, and consequently, a high pressure is generated in the spill valve back pressure chamber 44 as soon as the pressure in the fuel spill chamber 42 becomes high. As a result, a strong force urging the spill valve 31 in the open direction thereof acts on the spill valve 31 due to the fuel pressure in the spill valve back pressure chamber 44, and therefore, when the piezoelectric element 77 is contracted to stop the fuel injection, it is possible to rapidly open the spill valve 31 and keep the spill valve 31 in an open state.

FIGS. 15 through 18 illustrate a fourth embodiment of the unit injector. In FIGS. 15 through 18, similar components are indicated with reference to the same reference numerals used in FIGS. 1 through 7.

Figure 18:
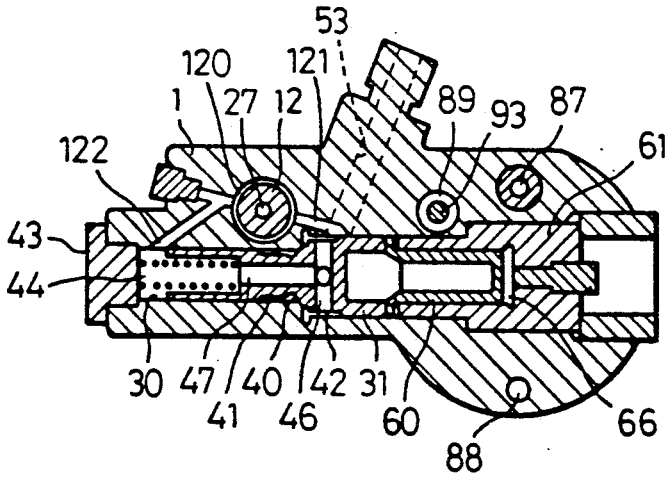
FIG. 18 is a cross-sectional plan view of the unit injector, taken along the line XIIX—XIIX in FIG. 15.
Figure 19:
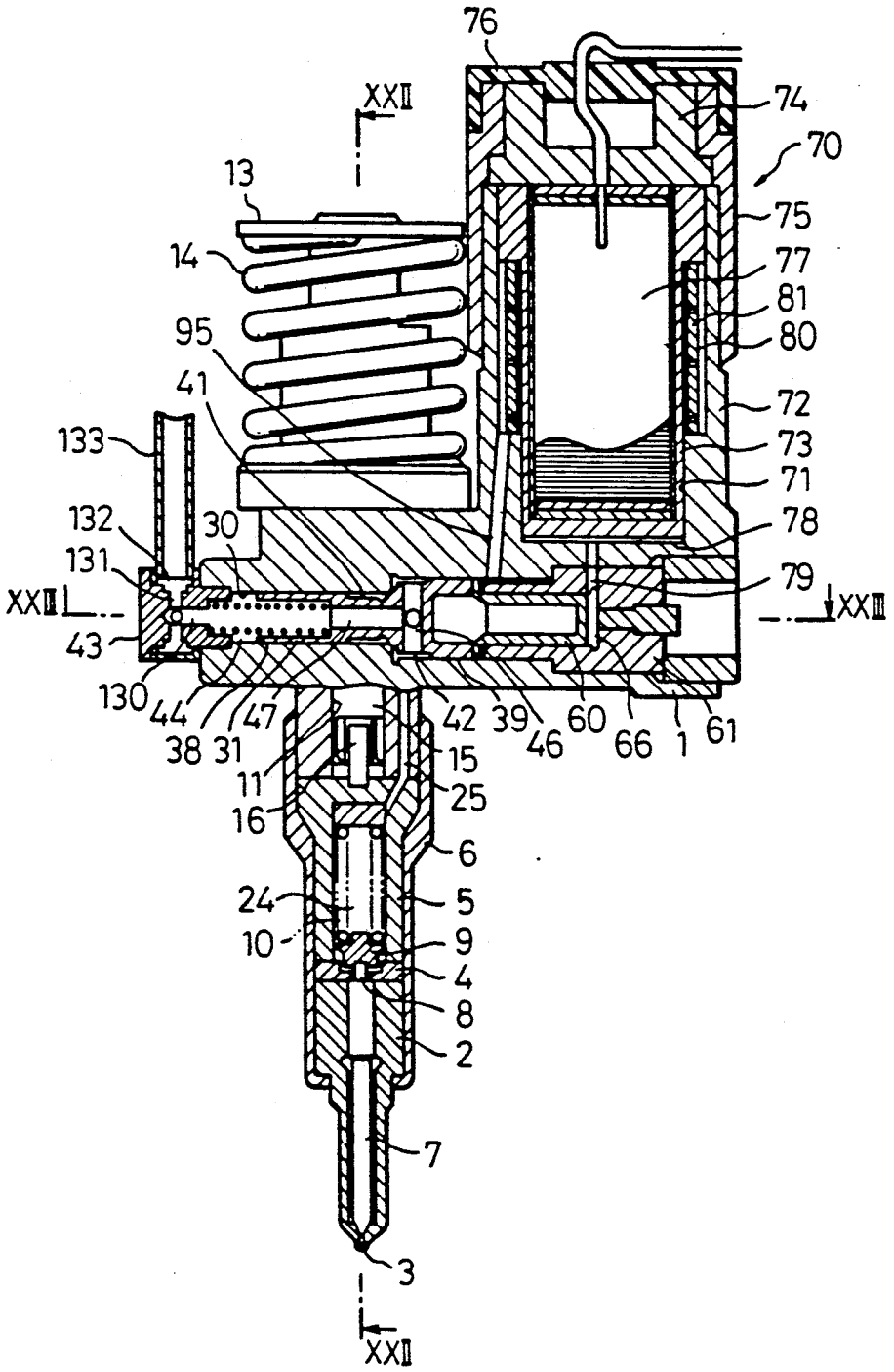
FIG. 19 is a cross-sectional side view of a fifth embodiment of the unit injector, taken along the line XIX—XIX in FIG. 22.
Figure 20:
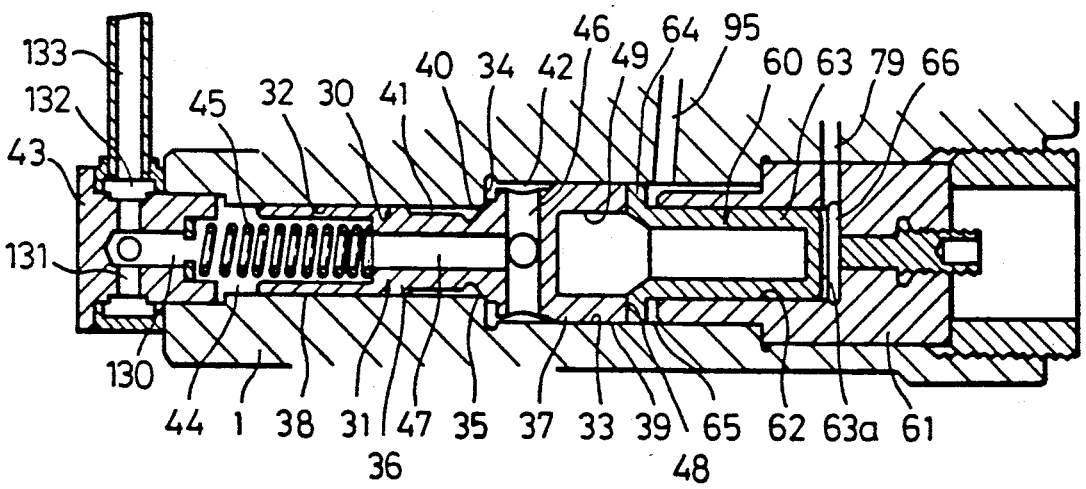
FIG. 20 is an enlarged cross-sectional side view of a portion of the unit injector shown in FIG. 19.

Referring to FIGS. 15 through 18, in this embodiment, an annular groove 120 is formed on the inner circumferential wall of the plunger bore 11 at a position slightly higher than the fuel supply port 20, and the circumferential groove 26 formed on the plunger 12 is formed at a position wherein, when the plunger 12 is moved downward to the vicinity of the lowermost position, the circumferential groove 26 is in communication with the annular groove 120. As illustrated in FIG. 18, the annular groove 120 is connected, on one hand, to the fuel spill chamber 42 via a fuel passage 121, and on the other hand, to the spill valve back pressure chamber 44 via a fuel passage 122, and thus the spill valve back pressure chamber 44 is in communication with the fuel spill chamber 42 via the fuel passages 121 and 122. Consequently, in this embodiment, the spill valve back pressure chamber 44 is in communication with the fuel spill chamber 42 via the fuel passages 46 and 47 formed in the spill valve 31 and via the fuel passages 121 and 122 formed in the housing body 1.

When the piezoelectric element 77 is contracted to stop the fuel injection, and thus the fuel under high pressure is spouted into the fuel spill chamber 42, a part of the fuel under high pressure spouted into the fuel spill chamber 42 is fed into the spill valve back pressure chamber 44, on one hand via the fuel passages 46 and 47 formed in the spill valve 31, and on the other hand via the fuel passages 121 and 122 formed in the housing body 1. Consequently, a high pressure is generated in the spill valve back pressure chamber 44 as soon as the pressure in the fuel spill chamber 42 becomes high, and as a result, a strong force urging the spill valve 31 in the open direction thereof acts on the spill valve 31 due to the fuel pressure in the spill valve back pressure chamber 44. Therefore, when the piezoelectric element 77 is contracted to stop the fuel injection, it is possible to rapidly open the spill valve 31 and keep the spill valve 31 in an open state.

In addition, as mentioned above, when the plunger 12 is moved to the vicinity of the lowermost position thereof, the circumferential groove 26 formed on the outer circumferential wall of the plunger 12 is in communication with the annular groove 120. At this time, when the spill valve 31 is kept closed for some reason, the fuel pressure in the high pressure fuel chamber 15 is kept high, and therefore, when the circumferential groove 26 is in communication with the annular groove 120, the fuel under high pressure introduced into the annular groove 120 from the fuel escape bore 27 via the circumferential groove 26 is fed, on one hand into the fuel spill chamber 42 via the fuel passage 121, and on the other hand into the spill valve back pressure chamber 44 via the fuel passage 122, and as a result, since the fuel pressure in the spill valve back pressure chamber 46 and the fuel spill chamber 42 becomes high, a strong force urging the spill valve 31 in the open direction thereof acts on the spill valve 31, and thus the spill valve 31 is forcibly opened. Consequently, the circumferential groove 26 and the annular groove 120 act as a failsafe factor preventing the spill valve 31 from being kept closed for some reason.

FIGS. 19 through 23 illustrate a fifth embodiment of the unit injector. In FIGS. 19 through 23, similar components are indicated by the same reference numerals as used in FIGS. 1 through FIG. 7.

Referring to FIGS. 19 through 23, in this embodiment, a fuel outlet 130 is formed in the blind plug 43, and the spill valve back pressure chamber 44 is in communication with the fuel outlet 130. This fuel outlet 130 is connected to an annular fuel discharge passage 132 via a plurality of radially extending fuel discharge passages 131, and the annular fuel discharge passage 132 is connected, for example, to a fuel tank (not shown) via a fuel discharge pipe 133. As can be seen from FIG. 23, in this embodiment, a fuel discharge passage directly connected to the fuel spill chamber 42, as illustrated by reference numeral 53 in FIG. 7, is not provided. Consequently, all of the fuel spilled out into the fuel spill chamber 42 is returned, for example, to the fuel tank, via the fuel passages 46 and 47 of the spill valve 31 and via the spill valve back pressure chamber 44 and the fuel outlet 130.

In this embodiment, when the piezoelectric element 77 is contracted to stop the fuel injection, and thus the fuel under high pressure is spouted into the fuel spill chamber 42, all of the fuel under high pressure spouted into the fuel spill chamber 42 is fed into the spill valve back pressure chamber 44 via the fuel passages 46 and 47 of the spill valve 31. Consequently, in this embodiment, a large amount of fuel is spouted from the fuel passage 47 into the spill valve back pressure chamber 44, and as a result, since the reaction force of the spouting operation of fuel from the fuel passage 27 becomes large, a strong force urging the spill valve 31 in the open direction thereof acts on the spill valve 31 due to this reaction force. Therefore, when the piezoelectric element 77 is contracted to stop the fuel injection, it is possible to rapidly open the spill valve 31 and keep the spill valve 31 in an open state.

Figure 21:
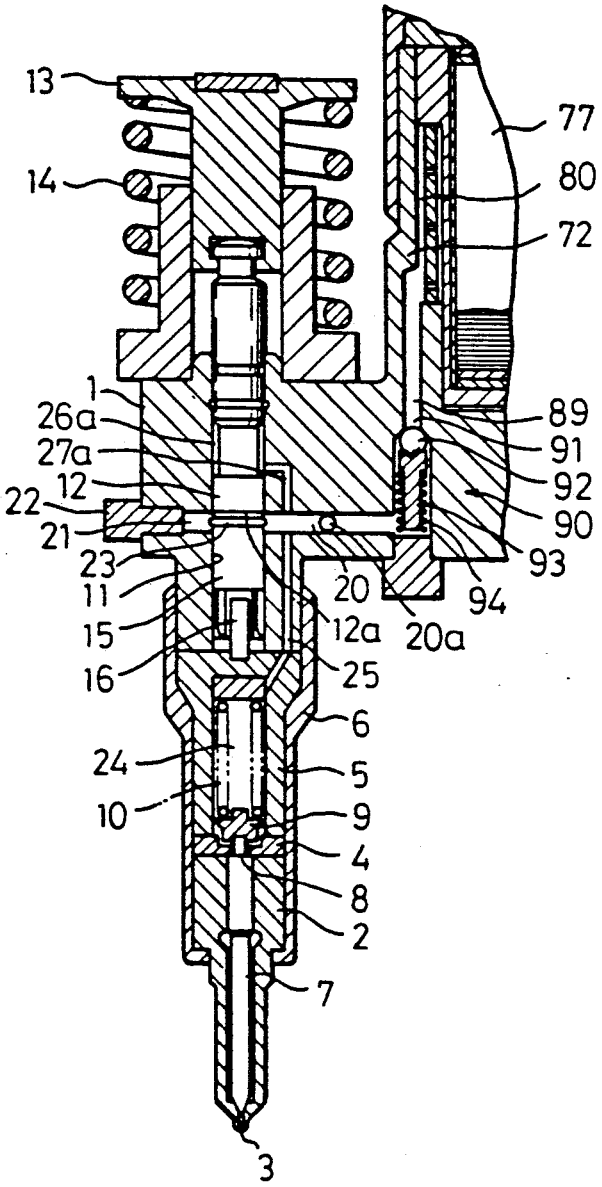
FIG. 21 is a cross-sectional side view of the unit injector shown in FIG. 19, taken along the line—XXI—XXI in FIG. 22.
Figure 22:
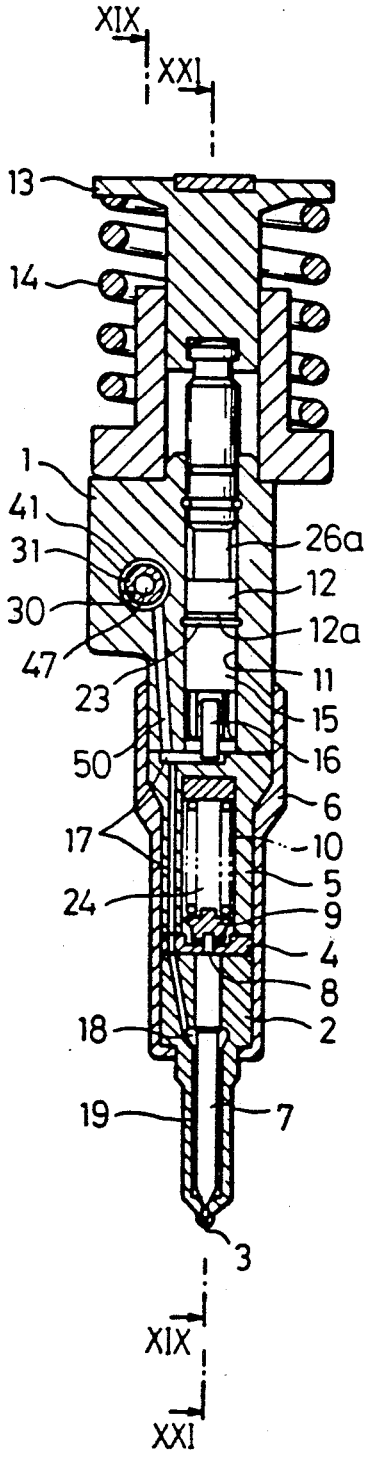
FIG. 22 is a cross-sectional side view of the unit injector, taken along the line XXII—XXII in FIG. 19.
Figure 23:
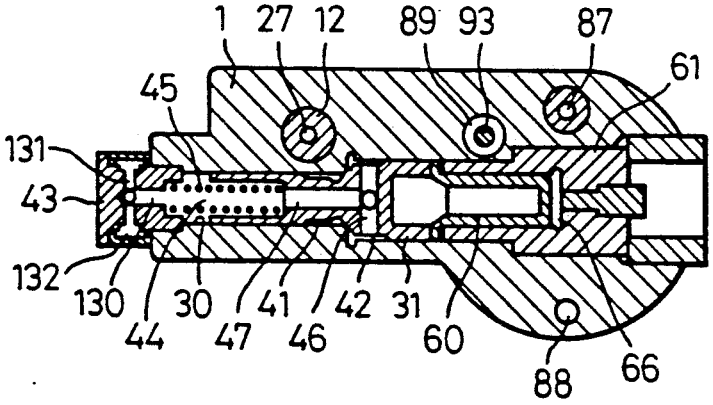
FIG. 23 is a cross sectional plan view of the unit injector, taken along the line XXIII—XXIII in FIG. 19.

In addition, in this embodiment, as illustrated in FIG. 21, a circumferential groove 26*a* having a relatively large width is formed on the outer circumferential wall of the plunger 12 at a position slightly higher than the lower end face 12*a* of the plunger 12. This circumferential groove 26a is continuously connected to the fuel feed port 20 via a fuel return passage 27a formed in the housing body 1, to return fuel which has leaked into the circumferential groove 26a to the fuel feed port 20.

According to the present invention, when the spill valve is opened to stop the fuel injection, the spill valve is kept open thereafter, and consequently, since the needle immediately closes the nozzle opening, the fuel injection does not continue under a low pressure, and thus a good combustion can be obtained.

Although the invention has been described with reference to specific embodiments chosen for purposes of illustration, it should be apparent that numerous modifications could be made thereto by those skilled in the art without departing from the basic concept and scope of the invention.

We claim:

1. A fuel injection device of an engine comprising:

a housing having a nozzle opening;

a plunger movable in said housing and actuated by the engine;

a high pressure fuel chamber formed in said housing and defined by said plunger, the pressure of fuel in said high pressure fuel chamber being increased by said plunger; a needle arranged in said housing and opening said nozzle opening to inject fuel in said high pressure fuel chamber from said nozzle opening when the pressure of fuel in said high pressure fuel chamber is higher than a predetermined pressure;

a spill valve slidably inserted into a bore formed in said housing, said bore having a reduced diameter bore portion , an increased diameter bore portion, ad a step portion formed between said reduced diameter bore portion and said increased diameter bore portion and forming an annular valve seat thereon, said spill vale having a reduced diameter portion slidably inserted int said reduced diameter bore portion and an increased diameter portion slidably inserted into said increased diameter bore portion, said reduced diameter portion of said spill valve and said increased diameter portion of said spill valve being spaced in an axial direction of said bore and in tight contact with an inner circumferential wall of said bore, said spill valve having an annular valve portion which is formed thereon between said reduced diameter portion and said increased diameter portion and can be seated on said annular valve seat, said spill valve and the inner circumferential wall of said bore defining therebetween a high pressure fuel introduction chamber which is positioned between said annular valve portion and said reduced diameter portion and is in continuous communication with said high pressure fuel chamber, said spill valve and sad inner circumferential wall of said bore defining therebetween a fuel spill chamber positioned between said annular valve portion and said increased diameter portion; and an actuator for actuating said spill valve to seat said annular vale portion on said annular valve seat when a fuel injection is to be carried out and to move said annular valve portion away from said annular valve seat to spill out fuel inn said high pressure fuel chamber into said fuel spill chamber via said high pressure fuel introduction chamber when the fuel injection is to be stopped.

2. A fuel injection device according to claim 1, wherein a seal ring is inserted between said increased diameter bore portion and said increased diameter portion of said spill valve.

3. A fuel injection device according to claim 1, wherein said housing has a pressure control chamber formed therein coaxially with said spill valve, and pressure in said pressure control chamber is controlled by said actuator, said spill valve being controlled by the pressure in said pressure control chamber.

4. A fuel injection device according to claim 3, wherein a rod is inserted between said spill valve and said pressure control chamber, and the pressure in said pressure control chamber is applied to said spill valve via sad rod.

5. A fuel injection device according to claim 4, wherein said rod comprises an increased diameter portion slidably inserted into said bore, and said increased diameter portion of said rod has one end face abutting against said spill valve and another end face formed opposite to said one end face and defining a rod back pressure chamber, fuel under pressure being introduced into said rod back pressure chamber.

6. A fuel injection device according to claim 4, wherein said rod comprises an increased diameter portion slidably inserted into said bore, and said increased diameter portion of said rod has one end face abutting against said spill valve and another end face formed opposite to said one end face and defining a rod back pressure chamber, atmospheric pressure being applied to said rod back pressure chamber.

7. A fuel injection device according to claim 6, wherein said housing has a plunger bore receiving said plunger therein and having a circumferential groove formed on a wall thereof, and said housing has an atmospheric pressure bore connected to said rod back pressure chamber and extending via said circumferential groove.

8. A fuel injection device according to claim 1, wherein a spill valve back pressure chamber defined by said reduced diameter portion of said spill valve and continuously connected to said fuel spill chamber is formed within, said reduced diameter bore portion at a position opposite to said high pressure fuel introduction chamber with respect to said first annular fitting portion, and a compression spring is arranged in said spill valve back pressure chamber to bias said spill valve in a direction in which said annular valve portion is moved away from said annular valve seat.

9. A fuel injection device according to claim 8, wherein said spill valve has a fuel passage formed therein and continuously connecting said spill valve back pressure chamber to said fuel spill chamber.

10. A fuel injection device according to claim 9, wherein said housing has another fuel passage formed therein and continuously connecting said spill valve back pressure chamber to said fuel spill chamber.

11. A fuel injection device according to claim 10, wherein said housing has a plunger bore receiving said plunger therein and having a circumferential groove formed on a wall thereof, and said other fuel passage extends via said circumferential groove.

12. A fuel injection device according to claim 11, wherein said plunger has a circumferential groove formed thereon and continuously connected to said high pressure fuel chamber, said circumferential groove of said plunger being in communication with said circumferential groove of said plunger bore when said plunger reaches an end of a compression stroke.

13. A fuel injection device according to claim 8, wherein said fuel spill chamber has a fuel discharge passage which is open thereto to discharge fuel from said fuel spill chamber.

14. A fuel injection device according to claim 8, wherein said spill valve back pressure chamber has a fuel discharge passage which is open thereto to discharge fuel from said spill valve back pressure chamber.

15. A fuel injection device according to claim 8, wherein said housing has a fuel supply port which is open to said high pressure fuel chamber when said plunger is at a compression starting position to feed fuel under pressure into said high pressure fuel chamber, and said spill valve back pressure chamber is continuously connected to said fuel supply port.

16. A fuel injection device according to claim 15, wherein said housing has a fuel port which is arranged to be aligned with said fuel supply port at a position opposite to said fuel supply port with respect to said plunger and is open to said high pressure fuel chamber when said plunger is at the compression starting position, said fuel port being continuously connected to said spill valve back pressure chamber, said housing having a plunger bore which receives said plunger therein and has a circumferential groove formed on a wall thereof and continuously connecting said fuel port to said fuel supply port.

17. A fuel injection device according to claim 16, wherein said plunger has a circumferential groove formed thereon and continuously connected to said high pressure fuel chamber, said circumferential groove of said plunger being in communication with both said fuel port and said fuel supply port when said plunger reaches an end of a compression stroke.

18. A fuel injection device according to claim 15, wherein said fuel supply port has therein a check valve which permits only an inflow of fuel under pressure into said high pressure fuel chamber.

19. A fuel injection device according to claim 1, wherein said housing has a fuel supply port which is open to said high pressure fuel chamber when said plunger is at a compression starting position to feed fuel under pressure into said high pressure fuel chamber, and said housing has a fuel port which is arranged to be aligned with said fuel supply port at a position opposite to said fuel supply port with respect to said plunger and is open to said high pressure fuel chamber when said plunger is at the compression starting position, said housing having a plunger bore which receives said plunger therein and has a circumferential groove formed on a wall thereof and continuously connecting said fuel port to said fuel supply port.

20. A fuel injection device according to claim 19, wherein said plunger has a circumferential groove formed thereon and continuously connected to said fuel supply port.

21. A fuel injection device according to claim 1, wherein said needle is substantially aligned with said plunger, and said high pressure fuel chamber is arranged between said needle and said plunger, said bore being spaced from and extending in parallel to a line which intersects an axis of said needle substantially at a right angle.

22. A fuel injection device according to claim 1, wherein said actuator comprises a piston defining a variable volume chamber filled with fuel, and a piezoelectric element driving said piston, said spill valve being controlled by the pressure of fuel in said variable volume chamber.

23. A fuel injection device according to claim 22, wherein said housing has a fuel supply port which is open to said high pressure fuel chamber when said plunger is at a compression starting position, and said piezoelectric element is surrounded by a cooling chamber filled with fuel and having a fuel inlet and a fuel outlet connected to said fuel supply port.

* * * * *

UNITED STATES PATENT AND TRADEMARK OFFICE

CERTIFICATE OF CORRECTION

PATENT NO. : 5,076,241

DATED : December 31, 1991

INVENTOR(S) : Takeshi TAKAHASHI, et al.

It is certified that error appears in the above-identified patent and that said Letters Patent is hereby corrected as shown below:

ON THE TITLE PAGE

ABSTRACT, line 22, between "spill" and "and" insert --chamber via the high pressure fuel introduction chamber,--.

Column 2, line 13, change "are" to --is--.

Column 2, line 15, change "increase" to --increased--.

Column 2, line 31, delete "second annular fitting" and insert --increased diameter--.

Column 4, starting on line 25 to line 28, delete ". A compression spring" through "port 20".

Column 4, line 34, between "lower" and "face" change "and" to --enc--.

Column 13, line 25, after "plunger" delete the semicolon and insert a period. Start a new paragraph with "A needle arranged..."

Column 13, line 26, change "in" to --into--.

UNITED STATES PATENT AND TRADEMARK OFFICE

CERTIFICATE OF CORRECTION

PATENT NO. : 5,076,241

DATED : December 31, 1991

INVENTOR(S) : Takeshi TAKAHASHI, et al.

It is certified that error appears in the above-identified patent and that said Letters Patent is hereby corrected as shown below:

Column 13, line 38, change "vale" to --valve--.

Column 13, line 39, change "int" to --into--.

Column 13, line 56, change "sad" to --said--.

Column 13, line 62, change "vale" to --valve--.

Column 13, line 65, change "inn" to --in--.

Column 14, line 15, change "sad" to --said--.

Column 14, line 44, after "within" delete the comma.

Column 13, line 35, "ad" should read --and--.

Signed and Sealed this

Tenth Day of August, 1993

*Attest:*

Michael K. Kirk

MICHAEL K. KIRK

*Attesting Officer*

*Acting Commissioner of Patents and Trademarks*